US007004433B2

(12) United States Patent
Clausen et al.

(10) Patent No.: US 7,004,433 B2
(45) Date of Patent: Feb. 28, 2006

(54) ORGANIZER FOR CLOTHES IRON AND ACCESSORIES

(75) Inventors: Ken Clausen, Doylestown, OH (US); Lisa Kern, Wooster, OH (US); Mike Maczuzak, Wickliffe, OH (US); Erin Q. Riddell, Lakewood, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/277,795

(22) Filed: Oct. 22, 2002

(65) Prior Publication Data

US 2004/0075029 A1 Apr. 22, 2004

(51) Int. Cl.
*D06F 75/40* (2006.01)

(52) U.S. Cl. ..... 248/117.1; 248/301

(58) Field of Classification Search ..... 248/215, 248/301, 340, 52, 117.1, 117.7, 300, 339, 248/309.2; 38/75, 79, 94, 107; D32/73, D32/71; 211/119.001, 119.004
See application file for complete search history.

(56) References Cited

U.S. PATENT DOCUMENTS

| | | | | | |
|---|---|---|---|---|---|
| D155,897 | S | * | 11/1949 | Huntington | D6/523 |
| 3,698,674 | A | | 10/1972 | Paone | 248/117.6 |
| 3,951,369 | A | | 4/1976 | Kocsak | 248/117.6 |
| D261,219 | S | | 10/1981 | Latimer | D32/73 |
| D275,043 | S | | 8/1984 | Mulay | D32/73 |
| D280,455 | S | | 9/1985 | Negrich | D32/73 |
| 4,893,770 | A | * | 1/1990 | Bejak et al. | 248/117.1 |
| 5,154,379 | A | | 10/1992 | Parish | 248/117.6 |
| 5,433,355 | A | * | 7/1995 | Watkins | 223/1 |
| D369,006 | S | | 4/1996 | Pool | D32/73 |
| D386,638 | S | * | 11/1997 | Fong | D6/518 |
| D386,864 | S | | 11/1997 | Ratliff et al. | D32/73 |
| D393,119 | S | | 3/1998 | Pool | D32/73 |
| D416,365 | S | | 11/1999 | Case et al. | D32/75 |
| D433,552 | S | | 11/2000 | McBounds et al. | D32/73 |
| D451,254 | S | | 11/2001 | Egan | D32/73 |

* cited by examiner

*Primary Examiner*—Korie Chan
(74) *Attorney, Agent, or Firm*—Marshall, Gerstein & Borun LLP

(57) ABSTRACT

An organizer for a clothes iron and accessories thereof is disclosed. The organizer can be mounted on a wall in either a left-handed orientation where a clothes iron can be placed in the organizer from a left side of the organizer, or a right-handed orientation where a clothes iron can be placed in the organizer from a right side of the organizer. A support arm is attached to a base of the organizer. The support arm and the base, together define a pocket in which a clothes iron is suspended for support. The organizer can include an ironing board support for mounting/supporting an ironing board.

30 Claims, 7 Drawing Sheets

ORGANIZER FOR CLOTHES IRON AND ACCESSORIES

FIELD OF THE DISCLOSURE

This disclosure relates generally to clothes irons and, more particularly, to an organizer for a clothes iron and accessories.

BACKGROUND

Clothes iron organizers are typically designed to provide storage for a cloth iron when not in use. Such organizers may be attached to a support wall where the ironing of clothes is typically done. The support wall may also be a closet door or cabinet door. However, such organizers can be attached to a support wall in only one orientation, and such organizers may not provide any storage provisions for accessories of the clothes iron.

Depending on the space provided in a cabinet or a closet in which the organizer is mounted, or the position of the organizer on a wall on which the organizer is mounted, the organizer may not be easily accessible to all users. For instance, the organizer may be easily accessible to a right handed user, but pose difficulties for a left handed user (or vice versa) because of the organizer's position on a support wall. Furthermore, the organizer may not have provisions for storage of the clothes iron's power cord or accessories, such as an ironing board.

DESCRIPTION OF THE PREFERRED EXAMPLES

Figure 1:
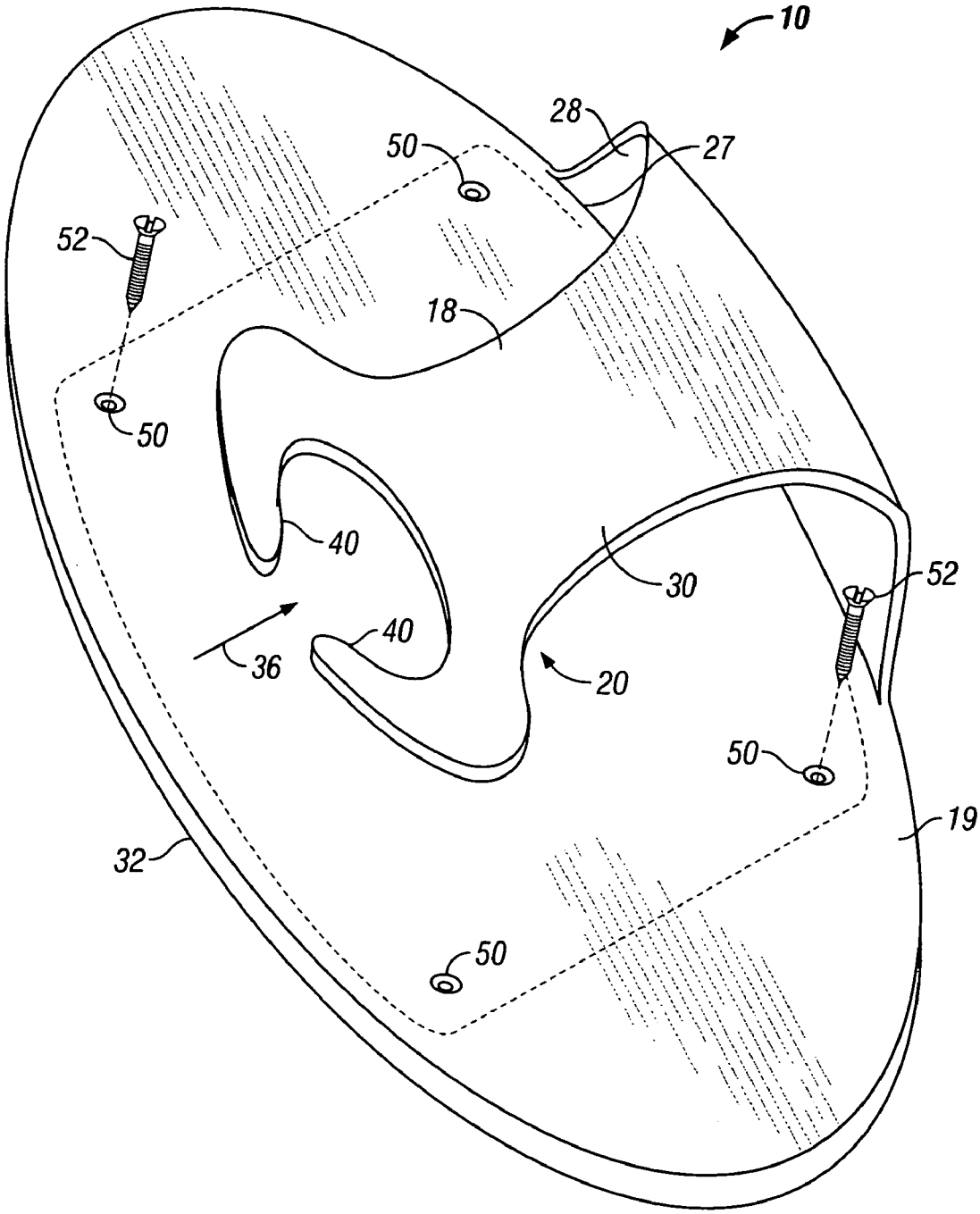
FIG. 1 is a perspective view of an organizer for a clothes iron shown in accordance with the teachings of the instant invention.

Referring to FIGS. 1–10, an organizer 10 for a clothes iron 12 and accessories thereof in accordance with the teachings of the invention is generally shown. The organizer 10 includes a base 16 that is mounted on a wall in either a left-handed orientation where a clothes iron 12 can be placed in the organizer 10 from a left side of the organizer 10, or a right-handed orientation where a clothes iron 12 can be placed in the organizer 10 from a right side of the organizer 10. A support arm 18 extends from the base 16 and has a portion that extends transversely relative to the base 16 to define a pocket 20 between the base 16 and the support arm 18. When placed in the pocket 20, the iron 12 is supported by being suspended from the support arm 18. Also, the iron 12 is balanced in such suspended position by having its heatable face 17 rest on an inner surface 19 of the base 16.

One of ordinary skill in the art will readily appreciate that the base 16 can be constructed in any geometric shape. In the preferred example, however, the base 16 is constructed in a generally elliptical shape, having a minor axis 24 and a major axis 26, to resemble the shape of a typical clothes iron 12. The base is mounted on a wall such that the minor axis is oriented horizontally and the major axis 26 is oriented vertically. The support arm 18 is attached to a lateral side 27 of the base 16. A connecting or first portion 28 of the support arm 18 extends somewhat perpendicularly away from the lateral side 27 of the base 12, and a transverse support or second portion 30 of the support arm 18, which hereinafter is referred to as the support portion 30, extends generally parallel to and spaced from the base inner surface 19. The support portion in this example also extends parallel the minor axis 24 and extends from the connecting portion 28 towards an opposing lateral side 32 of the base 16. The base 16, the connecting portion 28 arm 18, and the support portion 30 together define the pocket 20, in which the iron 12 is inserted through an access opening 36.

Figure 2:
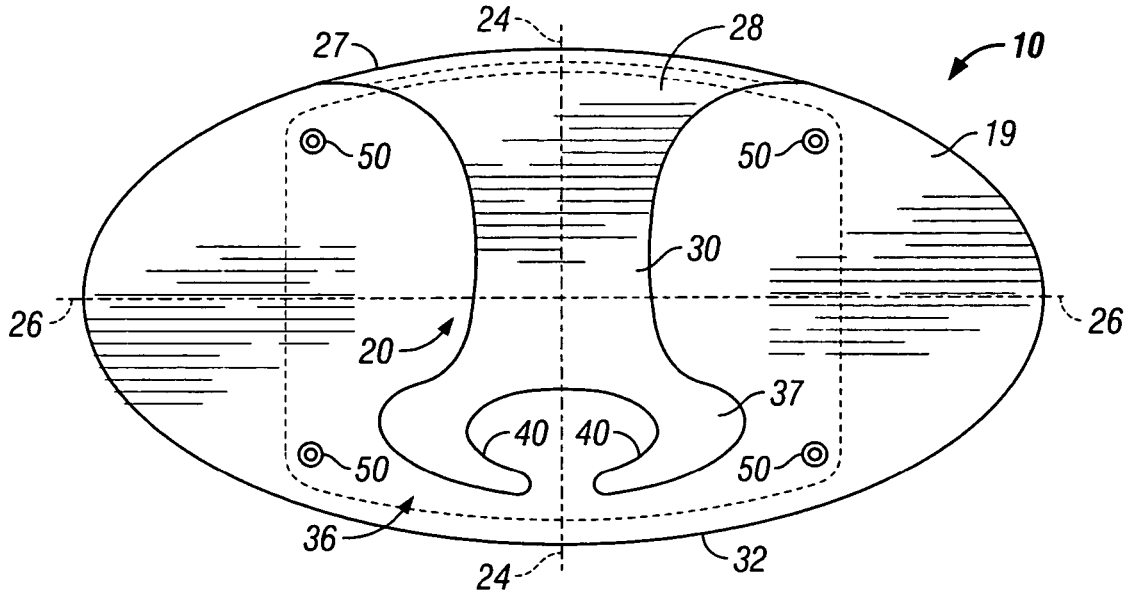
FIG. 2 is a top elevational view of the organizer of FIG. 1.
Figure 3:
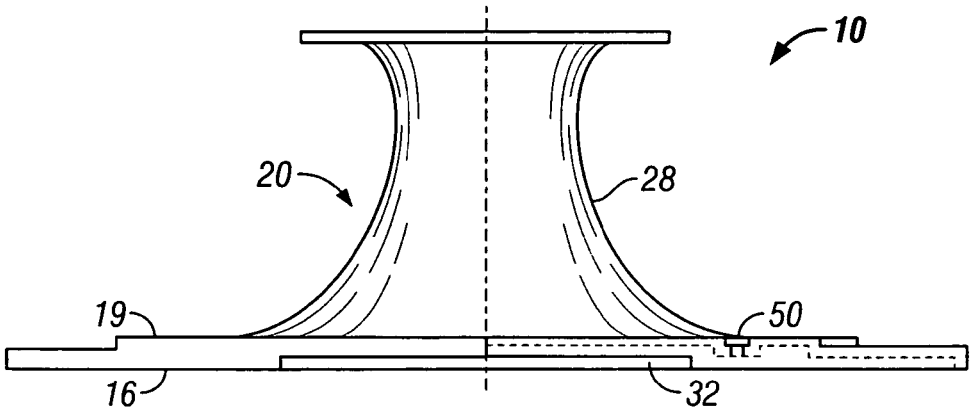
FIG. 3 is a front elevational view of the organizer of FIG. 1.
Figure 4:
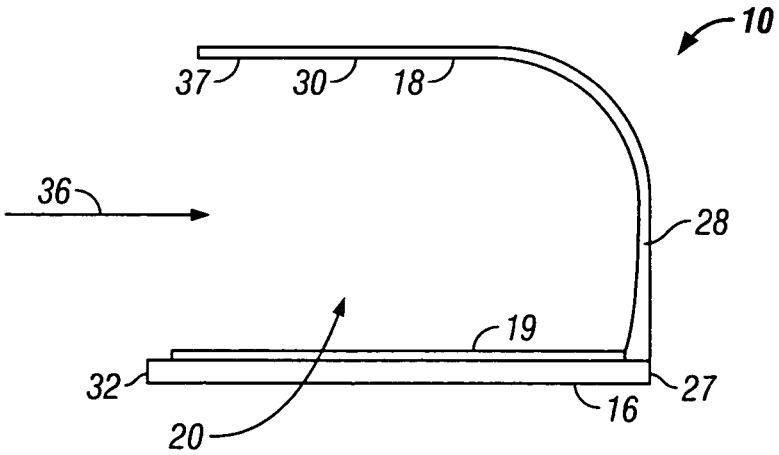
FIG. 4 is a side elevational view of the organizer of FIG. 1.

Referring to FIG. 2, the organizer 10 in this example is symmetric about the minor axis 24. Accordingly, the organizer 10 can be mounted so that the access opening 36 of the pocket 20 is disposed either on the left of the organizer 10 or on the right of the organizer 10. One of ordinary skill in the art will readily appreciate that symmetry of the organizer 10 about the minor axis 24 allows both right and left handed users to utilize the disclosed features of the organizer 10. A right handed user can mount the organizer on a wall with the access opening 36 disposed on the right side of the organizer 10. Similarly, a left handed user can mount the organizer on a wall with the access opening 36 disposed on the left side of the organizer 10. Regardless of the orientation by which the organizer 10 is mounted on a wall, the symmetry of the organizer 10 about the minor axis 24 provides multiple mounting configurations for the organizer 10.

A cord support 37 is attached to the support portion 30. The cord support 37 can provide storage for a power cord 38 of a clothes iron 12. For instance, the cord support 37 may be a hook 40, on which the cord 38 is hung or wrapped around. However, to preserve the symmetry of the organizer 10 about the minor axis 24, a pair of hooks 40 is provided on the free or distal end of the support portion 30. Thus, in each of the left-handed or right-handed mounting orientations of the organizer 10, a hook 40 is available for supporting the cord 38. One of ordinary skill in the art will appreciate that a pair of hooks 40 is only one structure among many well known examples by which the cord 38 can be supported. For instance, the cord support 37 may be a ring for placing the cord 38 through, a spool to wrap the cord 38 around, or a securable strap carried on the free end of support 30 and configured to wrap around the cord 38.

The base 16 can be mounted on a wall by a wide variety of methods well known to those of ordinary skill in the art. For instance, the base 16 can be mounted on a wall with adhesive. In one example, however, the base 16 can include a number of standard, hex head or recessed or tapered holes 50 for accommodating a corresponding number of tapered head screws 52 as shown. The recess in each recessed hole 50 houses the head of a corresponding screw 52 when tightened properly so that the top of the screws 52 are positioned flush with the inner surface 19 of the base 16. To preserve the symmetry of the organizer about the minor axis 24, the positions of the recessed holes 50 are preferably symmetric about the minor axis 24.

One of ordinary skill in the art will readily appreciate that the organizer can be constructed with a variety of materials, such as, wood, plastic, metal or combinations thereof. One of ordinary skill in the art will further appreciate that the inner surface 19 of the base 16 can be designed to either contact or be spaced from the heatable surface 17 of a clothes iron 12 when mounted in the organizer. This is because a user may immediately place the iron 12 in the organizer after use while the surface is still hot. Additionally, the material from which the organizer 10 is constructed provides adequate stiffness for mounting the organizer 10 on a wall to support an iron 12 and the iron's accessories.

Accordingly, in one example, the material from which the organizer 10, the base 16, or at least the inner surface 19 of the base 16 is constructed from is a calcium filled polypropylene. One of ordinary skill in the art will appreciate that other materials with stiffness and heat resistance are available for the construction of the organizer 10. For example, the organizer 10 can be constructed from polyester, high heat thermosets, or other plastics. To provide additional heat resistance to the inner surface 19 of the base 16, a number of spacers 60 can be disposed on the inner surface 19, which maintain separation between the inner surface 19 and the surface 17 of an iron 12. As a result, the surface 17 of an iron 12 does not contact the inner surface 19 in such an example, and instead bears against the spacers 60. The spacers 60 may be button shaped and can be constructed with a material having a high heat resistance. In one example, the spacers 60 are constructed from silicon. To preserve the symmetry of the organizer 10, the spacers 60 are disposed on the inner surface 19 in such a manner so as to be symmetric about the minor axis 24 in both quantity and location.

One of ordinary skill in the art will readily appreciate that a variety of well known methods can be utilized to provide additional heat resistance on the inner surface 19. For instance, a piece of insulative and/or heat resistant material shaped similar to the shape of the base 16 can be attached to the inner surface 19, to thereby contact the heatable surface 17 of the iron 12 and shield the inner surface 19 from heat.

Figure 6:
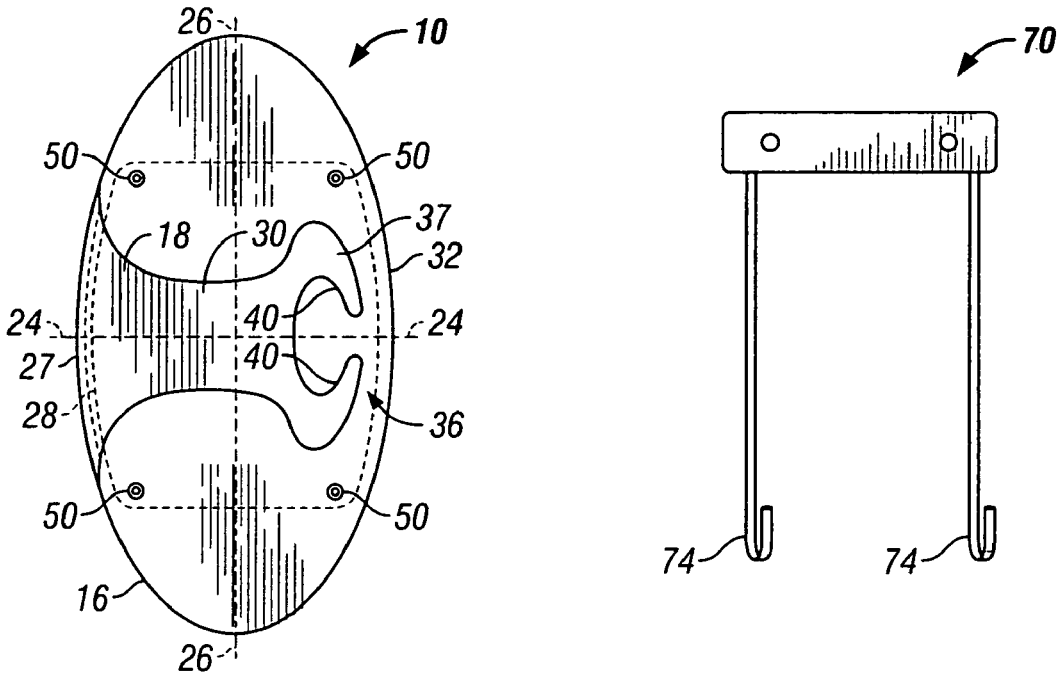
FIG. 6 is a frontal view of the organizer of FIG. 1 and an ironing board support in accordance with the teachings of the instant invention, shown as having been mounted separately on a wall.
Figure 7:
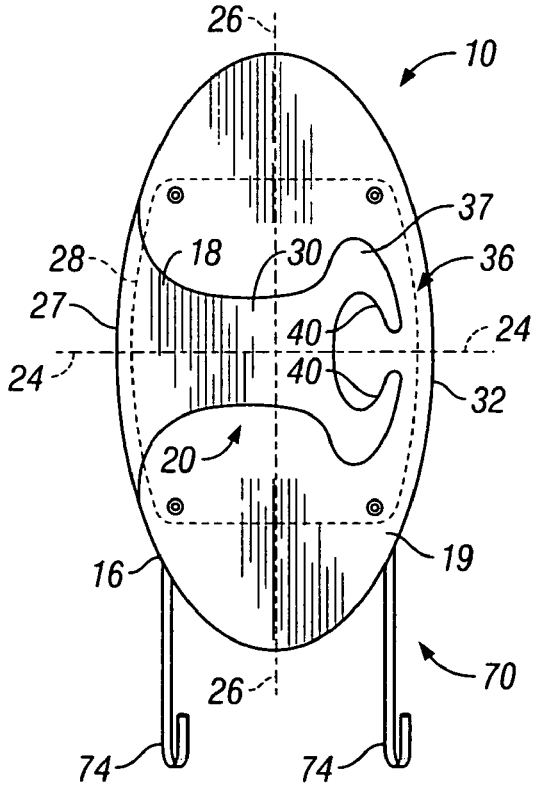
FIG. 7 is a frontal view of the organizer of FIG. 1 and an ironing board support in accordance with the teachings of the instant invention, shown as having been mounted together on a wall.
Figure 8:
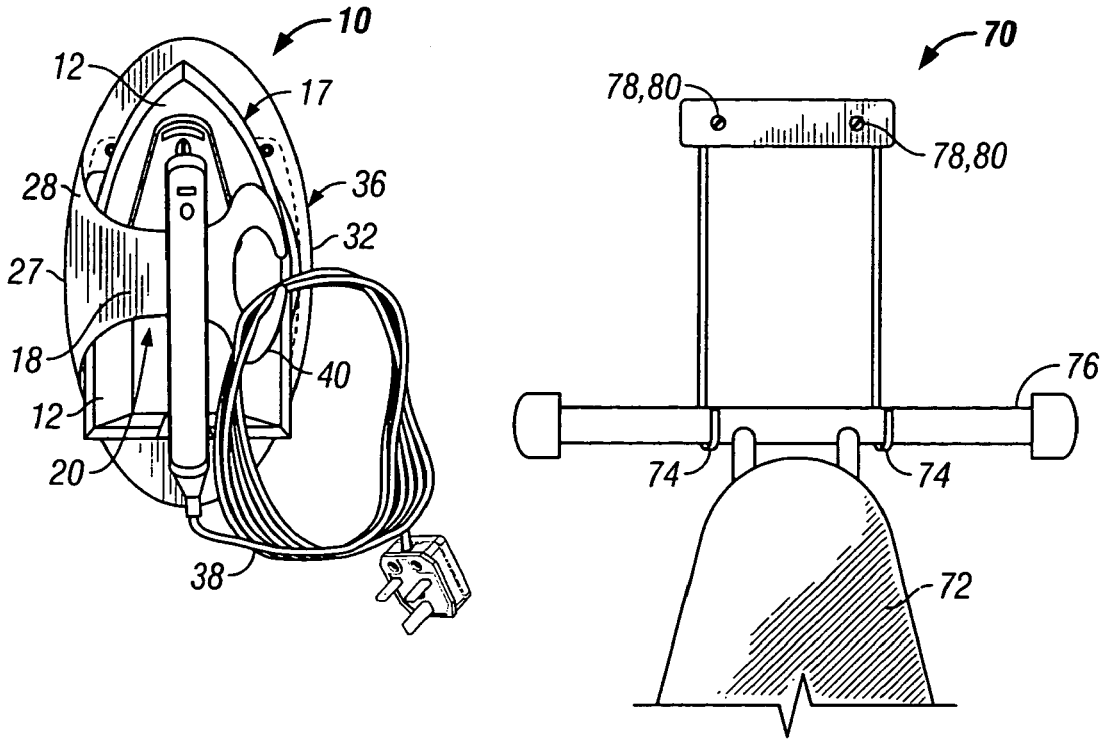
FIG. 8 is a frontal view of the organizer and the ironing board support of FIG. 6 as installed and shown supporting a clothes iron and an ironing board.
Figure 9:
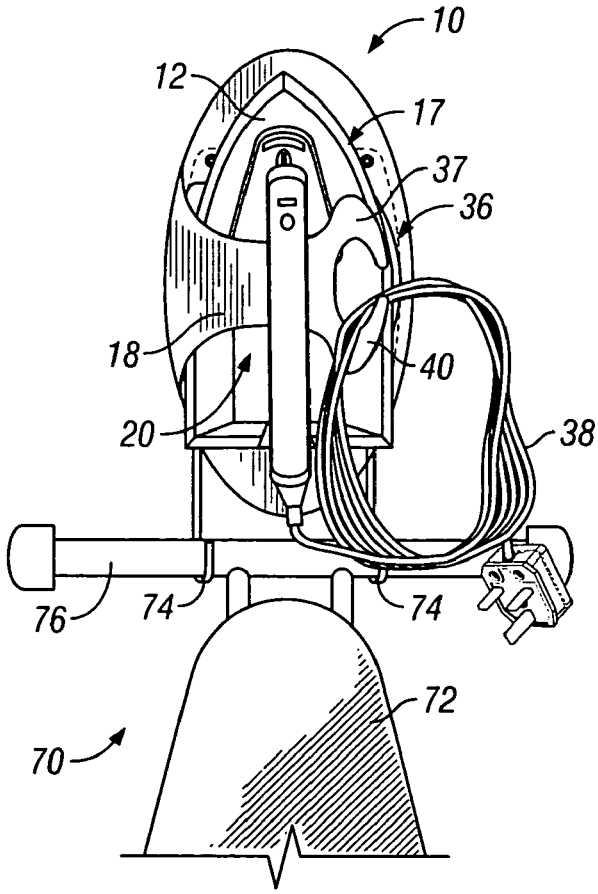
FIG. 9 is a frontal view the organizer and the ironing board support of FIG. 7 as installed and shown supporting a clothes iron and an ironing board.
Figure 10:
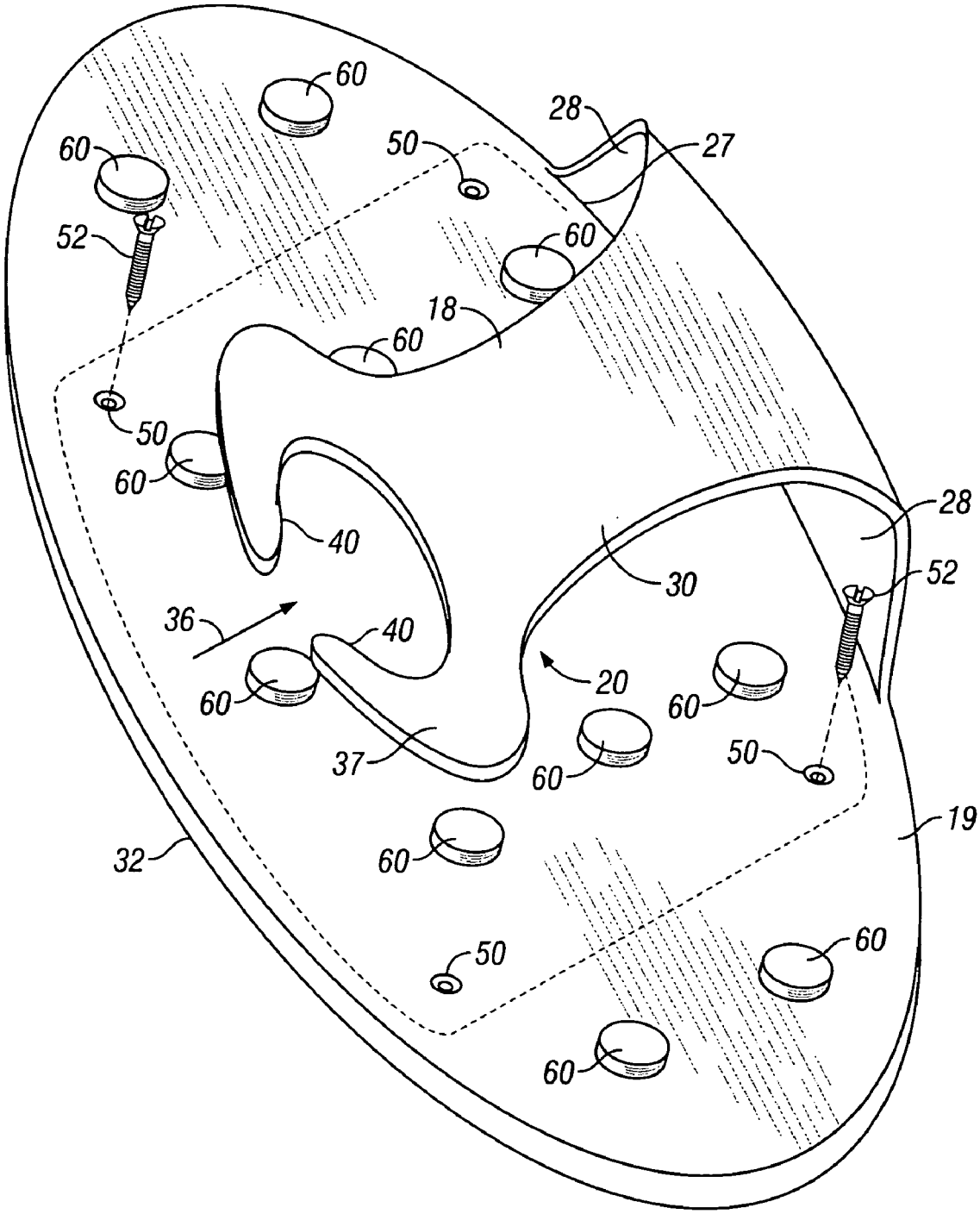
FIG. 10 is a perspective view of the organizer of FIG. 1 shown with spacers in accordance with the teachings of the instant invention.
Figure 11:
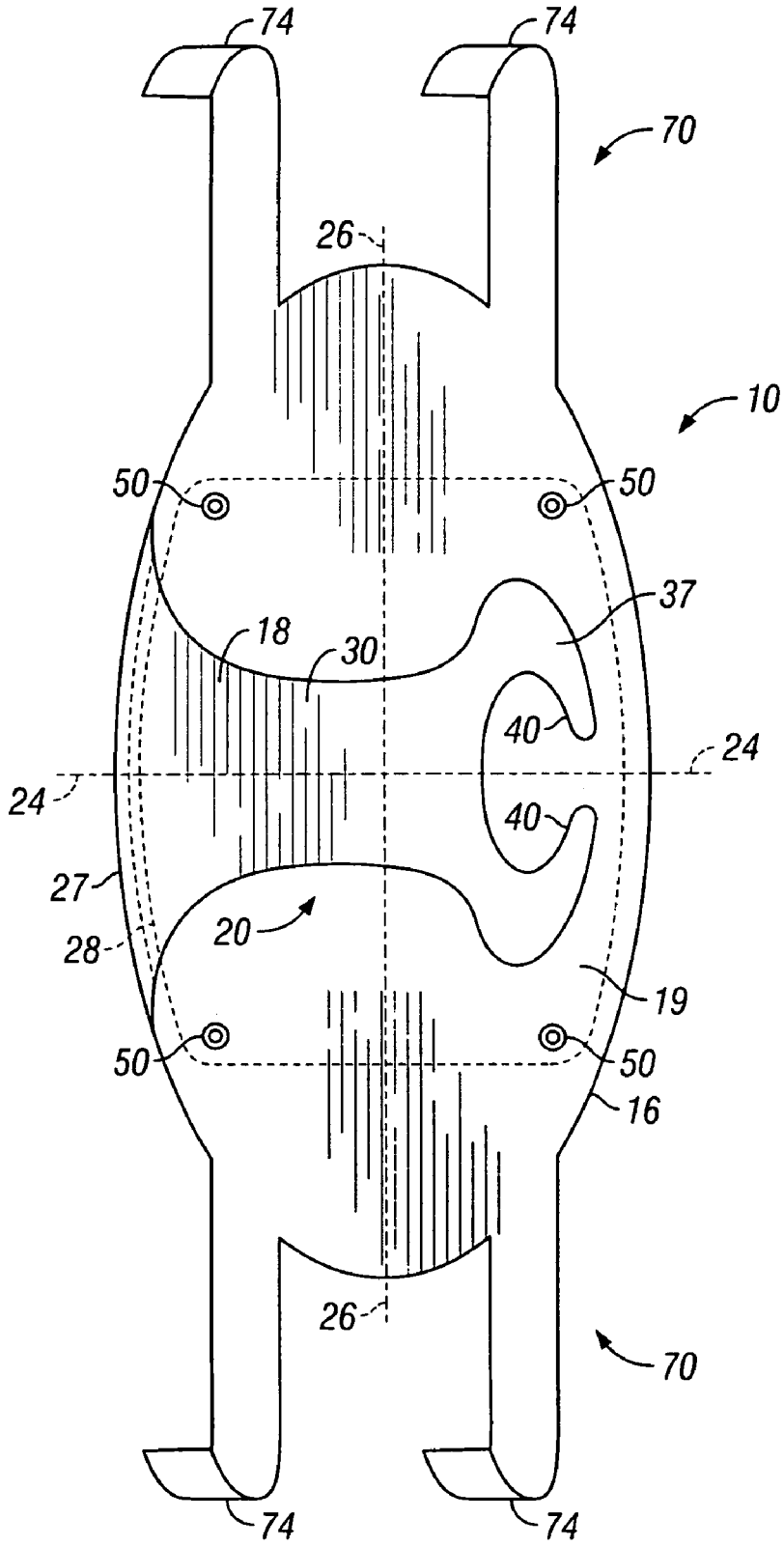
FIG. 11 is a frontal view of an organizer in accordance with the teachings of the instant invention including an integral ironing board support.

Referring to FIGS. 6, 9 and 11, the organizer 10 can include an ironing board support 70. One of ordinary skill in the art will readily appreciate that an ironing board 72 can be supported by a variety of methods. In one example, however, an ironing board 72 is suspended from the ironing board support 70. Accordingly, in one example, the ironing board support 70 includes a pair of support hooks 74 that engage portions of one of the leg supports 76 of the ironing board 72. The ironing board support 70 may be mounted on a wall separate from the base 16 with screws 78, as shown in FIGS. 6 and 8, mounted on a wall with the base 16, as shown in FIGS. 7 and 9, or be constructed as an integral part of the base 16 (not shown). When integrally formed with the base 16, as shown in FIG. 11, an ironing board support 74 can be provided at each end of the base 16, relative to the major axis 26, to accommodate either or left or right hand use.

When mounted on the wall with the base 16, screw holes 80 of the ironing board support 70 are aligned with the recessed holes 50 of the base 16 in this example, and the screws 52 are used to mount both the base 16 and the ironing board 70. One of ordinary skill in the art will readily appreciate the flexibility of configuring the organizer 10 and the ironing board support 70 depending on storage space limitations and storage preferences.

Figure 5:
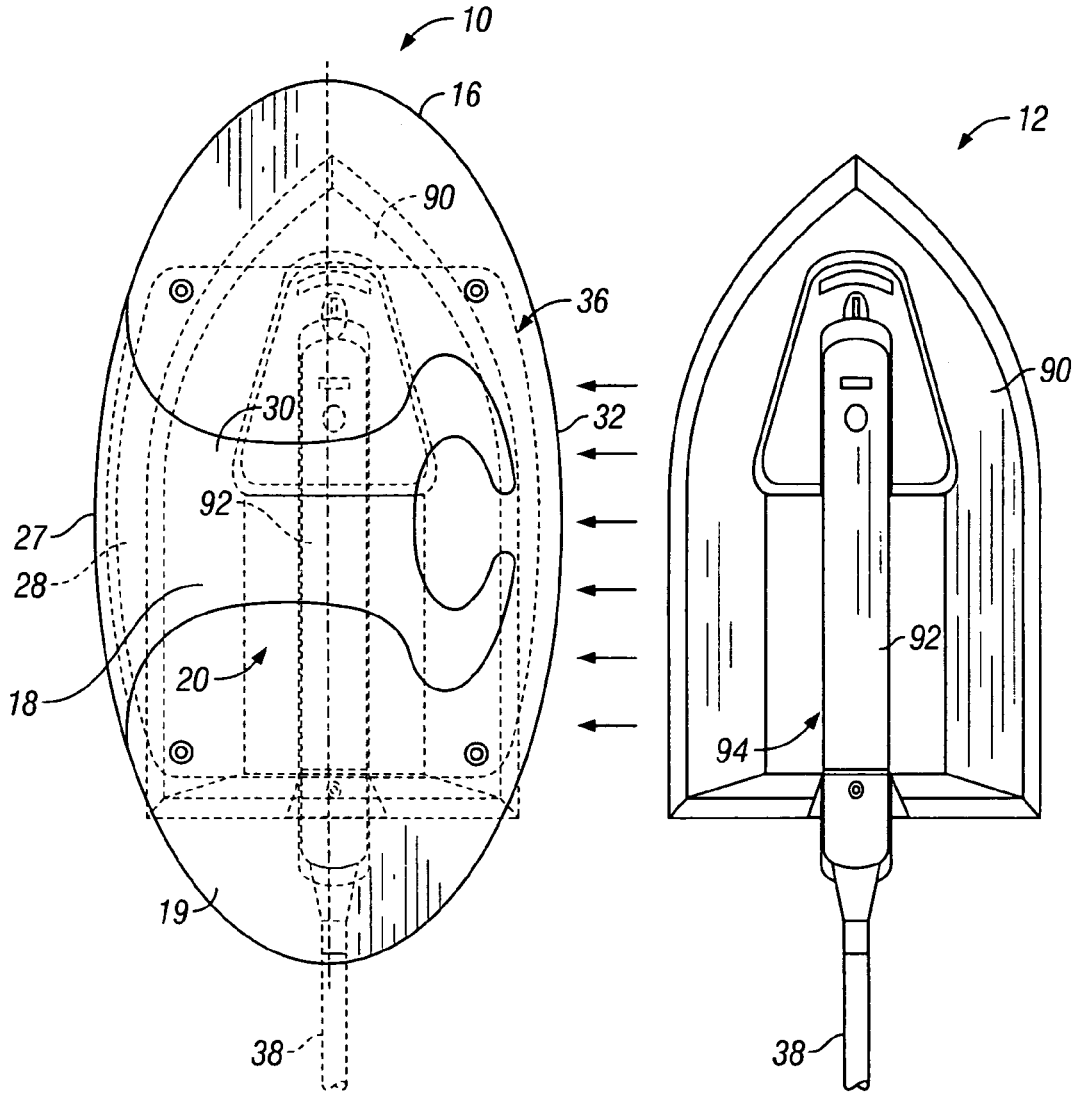
FIG. 5 is a frontal view of the organizer of FIG. 2 as installed and shown receiving a clothes iron.

Referring to FIG. 5, a clothes iron 12 is placed in the pocket 20 through the access opening 36 for storage thereof. Typical clothes irons 12 include a body 90 and a handle 92 that is attached to a forward portion of the body 90. A gap 94 between the handle 92 and the body 90 provides a space for a user's fingers when wrapped around the handle 92. When a clothes iron 12 is placed in the pocket 20 through the access opening 36, the body 90 of the clothes iron 12 occupies the pocket. As a result, the support portion 30 of the arm 18 occupies the gap 94. Thus, when the iron 12 is released after being placed in the pocket 20, the iron 12 becomes suspended from the support arm 18, while all or portions of the surface 17 of the iron 12 contact the spacers 60 of the inner surface 19 or the inner surface directly. The power cord 38 of the clothes iron 12 can then be suspended from one of the cord hooks 40 of the cord support 37.

Although certain apparatuses constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. An organizer and clothes iron combination, comprising:

a base having at least first and second sides, the base being mounted to a generally vertical surface via fastening means in contact with the vertical surface;

a support arm extending generally horizontally from the first side of the base and having a support portion spaced from and extending transversely relative to the base towards the second side;

a pocket formed between the base and the support arm;

an access opening into the pocket between the support portion and the base and open to the second side; and a clothes iron received through the access opening and suspended from the support arm.

2. A combination according to claim 1, wherein the base and the support arm are formed as a one-piece integral structure.

3. A combination according to claim 1, wherein the organizer is manufactured from a plastic material.

4. A combination according to claim 3, wherein the plastic material is a calcium filled polypropylene.

5. A combination according to claim 1, wherein the support portion defines a horizontal axis of the organizer, and wherein the organizer is symmetric about the horizontal axis.

6. A combination according to claim 5, wherein the symmetry of the organizer about the horizontal axis provides the base to be mounted on the wall such that the access opening of the pocket for receiving the iron can be selectively positioned on a right side or a left side of the organizer.

7. A combination according to claim 1, wherein at least a portion of the base is adapted to withstand contact with heated portions of the clothes iron.

8. A combination according to claim 1, wherein a cord support is provided on the support portion of the support arm.

9. A combination according to claim 1, further comprising an ironing board support coupled to a portion of the organizer.

10. A combination according to claim 9, wherein the ironing board support is detachably attached to the base.

11. A combination according to claim 9, wherein the ironing board support is formed integral with the base.

12. A combination according to claim 9, wherein the ironing board support includes at least one hook adapted to receive a portion of an ironing board to suspend the ironing board from the organizer.

13. The combination according to claim 1, wherein the organizer is mounted and oriented such that the access opening is positioned on a user selected one of the left side or a right side of the organizer.

14. An organizer for a clothes iron comprising:

a base having at least first and second sides;

a support arm extending from the first side of the base and having a support portion spaced from and extending transversely relative to the base towards the second side, wherein the support arm, the support portion and the base form a pocket for receiving a clothes iron;

an access opening between the support portion and the base extending across the second side; and a cord support provided on a portion of the organizer;

wherein the base is adapted to be mounted on a wall such that the support portion is in a horizontal orientation, wherein the clothes iron can be placed in the pocket by traveling generally horizontally through the access opening, and wherein the support arm can suspend the clothes iron when the clothes iron is placed in the pocket;

wherein at least a portion of the base includes heat resistant pads to withstand contact with heated portions of the clothes iron.

15. An organizer according to claim 14, wherein the base, the support arm, and the cord support are formed as a one-piece integral structure.

16. An organizer according to claim 14, wherein the support portion defines a horizontal axis of the organizer, and wherein the organizer is symmetric about the horizontal axis.

17. An organizer according to claim 16, wherein the symmetry of the organizer about the horizontal axis provides the base to be mounted on the wall such that the access opening of the pocket for receiving the iron can be selectively positioned on a right side or a left side of the organizer.

18. An organizer according to claim 14, wherein the cord support is provided on the support portion of the support arm.

19. An organizer and clothes iron combination, comprising:

a base having an outer surface mountable to a wall; and a support arm attached to a first side of the base, the support arm having a first portion extending away from the base and a second portion extending transversely towards a second side of the base, the second portion being spaced from the base to define a pocket having an access opening;

wherein the organizer is symmetric about a horizontal axis defined by the support arm such that the base is adapted to be mountable on a wall in a selective one of a first orientation having the access opening of the pocket on a right side of the organizer or a second orientation having the access opening of the pocket on a left side of the organizer; and a clothes iron, wherein the iron is supported by the organizer by being suspended on the support arm when placed in the pocket through the access opening in the pocket.

20. A combination according to claim 19, further comprising a cord support provided on the second portion of the support arm.

21. A combination according to claim 19, wherein at least a portion of the base is adapted to withstand contact with heated portions of the clothes iron.

22. A combination according to claim 19, wherein at least a portion of the base includes heat resistant pads to withstand contact with heated portions of the clothes iron.

23. A combination according to claim 19, further comprising an ironing board support formed integral with the base.

24. A combination according to claim 19, wherein the organizer is manufactured from a plastic material.

25. A wall mountable clothes iron organizer system for storing an iron and an ironing board comprising:

a base having an outer surface mountable to a wall;

a support arm attached to a first side of the base configured to support an iron, the support arm having a first portion extending away from the base and a second portion extending transversely towards a second side of the base, the second portion being spaced from the base to define a pocket having an access opening;

a cord support provided on the second portion of the support arm; and an ironing board support coupled with the base configured to support an ironing board;

wherein the organizer is symmetric about a horizontal axis defined by the support arm such that the base is adapted to be mountable on a wall in a selective one of a first orientation having the access opening of the pocket on a right side of the organizer or a second orientation having the access opening of the pocket on a left side of the organizer.

26. An organizer system according to claim 25, wherein the base, the support arm, the cord support, and the ironing board support form a one-piece integral structure.

27. An organizer system according to claim 25, wherein the organizer is manufactured from a plastic material.

28. An organizer system according to claim 25, wherein at least a portion of the base is adapted to withstand contact with heated portions of the clothes iron.

29. An organizer system according to claim 25, wherein at least a portion of the base includes heat resistant pads to withstand contact with heated portions of the clothes iron.

30. An organizer system according to claim 25, wherein the ironing board support includes a pair of hooks adapted to engage a portion of the ironing board in its portable configuration.

* * * * *

UNITED STATES PATENT AND TRADEMARK OFFICE

CERTIFICATE OF CORRECTION

PATENT NO. : 7,004,433 B2
APPLICATION NO. : 10/277795
DATED : February 28, 2006
INVENTOR(S) : Ken Clausen et al.

It is certified that error appears in the above-identified patent and that said Letters Patent is hereby corrected as shown below:

In the Claims:

Column 5, Line 30, please delete "base extending" and insert -- base and extending --.

Signed and Sealed this

Seventh Day of August, 2007

JON W. DUDAS
*Director of the United States Patent and Trademark Office*